US010959482B2

(12) United States Patent
Phillips et al.

(10) Patent No.: US 10,959,482 B2
(45) Date of Patent: Mar. 30, 2021

(54) SHOE COVER

(71) Applicant: THE FLOOR SHOW, LLC, New York, NY (US)

(72) Inventors: Stephanie Phillips, New York, NY (US); Donna Deseta, New York, NY (US)

(73) Assignee: THE FLOOR SHOW, LLC, New York, NY (US)

( * ) Notice: Subject to any disclaimer, the term of this patent is extended or adjusted under 35 U.S.C. 154(b) by 50 days.

(21) Appl. No.: 16/152,539

(22) Filed: Oct. 5, 2018

(65) Prior Publication Data

US 2019/0029359 A1 Jan. 31, 2019

Related U.S. Application Data

(63) Continuation-in-part of application No. 14/615,998, filed on Feb. 6, 2015, now abandoned.

(51) Int. Cl.
*A43B 3/16* (2006.01)
*A43B 3/18* (2006.01)

(52) U.S. Cl.
CPC . *A43B 3/16* (2013.01); *A43B 3/18* (2013.01)

(58) Field of Classification Search
CPC ..... A43B 3/16; A43B 3/18; A43B 7/1425
USPC ..... 36/7.1 R, 7.1 A
See application file for complete search history.

(56) References Cited

U.S. PATENT DOCUMENTS

| | | | | | |
|---|---|---|---|---|---|
| 37,413 | A * | 1/1863 | Wales | A43B 3/16 | 36/7.3 |
| 280,603 | A * | 7/1883 | Gillet | A43B 3/16 | 36/7.3 |
| 360,795 | A * | 4/1887 | Burr | A43B 3/16 | 36/7.3 |
| 368,479 | A * | 8/1887 | MacIlvaine | A43B 3/16 | 36/7.3 |
| 422,492 | A * | 3/1890 | Benedict | A43B 3/16 | 36/58.6 |
| 801,899 | A * | 10/1905 | McQuiston | A43B 3/0031 | 36/1 |
| 832,550 | A * | 10/1906 | Lepper | A43B 23/28 | 2/61 |
| 838,751 | A * | 12/1906 | Roberts | A43B 3/16 | 36/7.3 |
| 873,928 | A * | 12/1907 | Dopkins | A43B 3/16 | 36/58.6 |
| 874,340 | A * | 12/1907 | Hood | A43B 3/16 | 36/7.3 |
| 888,252 | A * | 5/1908 | McAulay | A43B 3/16 | 36/58.6 |

(Continued)

*Primary Examiner* — Jocelyn Bravo
(74) *Attorney, Agent, or Firm* — Norton Rose Fulbright US LLP

(57) ABSTRACT

A shoe cover for covering a shoe to present the look like the wearer is wearing a different pair of shoes. The shoe cover includes an upper piece configured to cover the shoe of a wearer, the upper piece sized to cover a specific shoe without being attached to the shoe while the shoe is worn. The shoe cover includes a sole piece coupled to a bottom of the upper piece and configured to grip surfaces as the wearer uses the shoe cover and a gripping insert secured within the cavity created of the upper piece to guard against slippage of the cover on the shoe with the intent of ensuring the safety of the wearer.

18 Claims, 15 Drawing Sheets

(56) References Cited

U.S. PATENT DOCUMENTS 1,057,108 A * 3/1913 Akins ..... A43B 3/16 36/58.6
1,095,834 A * 5/1914 Ferguson ..... A43B 3/16 36/7.3
1,105,270 A * 7/1914 Grosky ..... A43B 3/16 36/7.3
1,119,277 A * 12/1914 Gross ..... A43B 3/16 36/7.3
1,207,024 A * 12/1916 Griffin ..... A43B 5/18 36/7.5
1,208,772 A * 12/1916 Goodyear ..... A43B 3/20 36/7.4
1,219,507 A * 3/1917 Teare ..... A43B 3/20 36/7.2
1,494,236 A * 5/1924 Greathouse ..... A43B 3/18 36/58.5
1,506,074 A * 8/1924 Morrill ..... A43B 3/16 12/142 R
1,586,774 A * 6/1926 Bott ..... A43B 3/16 36/7.3
1,750,165 A * 3/1930 Dunbar ..... A43B 3/16 36/7.3
1,750,179 A * 3/1930 MacPherson ..... A43B 3/16 36/7.3
1,803,559 A * 5/1931 Riley ..... A43B 3/16 36/7.3
1,834,551 A * 12/1931 Riley ..... A43B 3/16 36/7.3
2,013,700 A 9/1935 Savale
2,078,732 A * 4/1937 Halmer ..... A43B 3/16 36/1
2,108,572 A * 2/1938 Wilkinson ..... A43B 3/16 36/7.3
2,142,981 A * 1/1939 Richards ..... A43B 3/16 36/7.3
2,171,654 A * 9/1939 Hinchliff ..... A43B 3/20 36/72 R
2,188,440 A * 1/1940 Hollier ..... A43B 3/16 36/7.3
2,229,563 A * 1/1941 Greenstein ..... A43B 3/16 36/72 R
2,319,239 A * 5/1943 Laird ..... A43B 3/16 36/7.3
2,447,284 A 8/1948 Sidnam et al.
2,475,417 A * 7/1949 Wysowski ..... A43B 7/1445 36/145
2,535,123 A * 12/1950 Demick ..... A43B 3/16 36/7.3
2,540,531 A * 2/1951 Johnston ..... A43B 3/16 36/4
2,554,376 A * 5/1951 Nelson ..... A43B 3/16 36/7.3
2,580,094 A * 12/1951 Higgs ..... A43B 7/1445 36/145
2,613,456 A * 10/1952 Amico ..... A43B 7/142 36/180
2,771,691 A * 11/1956 Luchs ..... A43B 17/00 36/10
2,799,951 A * 7/1957 Rogers ..... A43B 3/16 36/7.1 R
2,901,842 A * 9/1959 De Lucia ..... A43C 11/006 36/72 R
2,917,846 A * 12/1959 Scholl ..... A43B 7/144 36/145
2,959,875 A * 11/1960 Frese, Jr. ..... A41B 11/008 36/80
2,966,749 A * 1/1961 Dennison ..... A43B 3/16 36/7.3
2,977,691 A * 4/1961 Brown ..... A43B 3/16 36/7.3
2,986,823 A * 6/1961 Kos ..... A43B 3/16 36/7.1 R
3,017,705 A * 1/1962 Peters ..... A43B 3/16 128/893
3,026,635 A * 3/1962 Slade ..... A43B 3/16 36/7.3
3,034,231 A 5/1962 Schwartz
3,141,247 A * 7/1964 Mackay ..... A43B 3/16 36/7.1 R
3,177,596 A * 4/1965 Siger ..... A43B 3/16 36/7.1 R
3,196,559 A * 7/1965 Thompson ..... A43B 3/20 36/100
3,220,416 A * 11/1965 Brown ..... A43B 7/14 36/145
3,221,421 A * 12/1965 Liebmann ..... A43B 3/0078 36/100
3,270,442 A * 9/1966 Liebmann ..... A43B 3/0078 36/100
3,313,047 A * 4/1967 Svien ..... A43B 5/18 36/7.3
3,316,663 A * 5/1967 Neu ..... A43B 7/145 36/71
3,349,504 A * 10/1967 Shcarer ..... A43B 3/242 36/100
3,373,510 A * 3/1968 Memole ..... A43B 3/0078 36/100
3,402,323 A * 9/1968 Longstreth ..... A43B 3/163 361/223
3,621,592 A * 11/1971 Goldmerstein ..... A43B 3/16 36/138
3,724,107 A * 4/1973 Makinen ..... A43B 3/16 36/7.3
3,736,673 A * 6/1973 Dubner ..... A43B 7/145 36/44
3,821,858 A * 7/1974 Haselden ..... A43B 5/185 36/135
3,898,750 A * 8/1975 Epstein ..... A43B 3/163 36/49
4,083,124 A * 4/1978 Michalak ..... A43B 3/16 36/7.1 R
4,281,466 A * 8/1981 Malone ..... A43B 5/18 36/130
4,377,042 A * 3/1983 Bauer ..... A43B 13/36 36/101
4,392,311 A * 7/1983 Rudolf ..... A43B 3/16 36/50.1
4,516,336 A * 5/1985 Nissenbaum ..... A43B 3/16 36/7.1 R
4,538,368 A * 9/1985 Mugford ..... A43B 3/16 36/112
4,631,841 A * 12/1986 Hickey ..... A43B 7/1415 36/145
4,638,574 A * 1/1987 Roda ..... A43B 3/20 36/7.2
4,850,122 A * 7/1989 Schwab, Jr. ..... A43B 3/20 36/72 R
4,887,369 A * 12/1989 Bailey ..... A43B 3/24 36/101
4,896,438 A * 1/1990 DeBease ..... A43B 3/02 36/7.1 R
4,897,937 A * 2/1990 Misevich ..... A43B 7/144 36/43
4,908,960 A * 3/1990 Hoyt, Jr. ..... A43B 3/16 36/7.1 R
4,976,050 A * 12/1990 Houghteling ..... A43B 3/30 36/11
5,067,260 A * 11/1991 Jenkins, Jr. ..... A43B 3/02 36/7.1 R
5,144,759 A * 9/1992 Mascotte ..... A43B 3/16 36/7.1 R
5,259,126 A * 11/1993 Rosen ..... A43B 23/28 36/55
5,311,676 A * 5/1994 Hughes ..... A43B 3/24 36/100
5,315,767 A * 5/1994 Bradbury ..... A43B 3/16 36/135

(56) References Cited

U.S. PATENT DOCUMENTS 5,396,717 A * 3/1995 Bell ..... A43B 1/10 36/7.1 R
5,425,186 A * 6/1995 Hoyt ..... A43B 3/16 36/4
5,638,614 A * 6/1997 Hardy ..... A43B 3/16 36/113
5,737,776 A * 4/1998 Jennings ..... A41B 11/008 2/239
5,778,564 A * 7/1998 Kettner ..... A43B 3/24 36/100
5,791,163 A * 8/1998 Throneburg ..... A41B 11/02 2/239
5,813,143 A * 9/1998 Bell ..... A43C 15/06 36/59 R
5,813,149 A * 9/1998 Baker ..... A43B 11/00 36/105
5,845,416 A * 12/1998 Hands ..... A43B 3/16 36/2 R
5,890,302 A * 4/1999 Kirkis ..... A43B 3/163 36/138
5,956,867 A * 9/1999 Harton ..... A43B 3/16 36/115
5,983,526 A * 11/1999 Pawlik ..... A43B 3/18 36/51
5,983,528 A * 11/1999 Hartung ..... A43B 3/24 36/101
6,277,088 B1 * 8/2001 Novella ..... A43B 7/1425 128/898
6,339,888 B1 * 1/2002 Brunson ..... A43B 3/163 12/142 G
6,349,486 B1 2/2002 Lin
6,430,771 B2 * 8/2002 Ahern ..... A43B 3/00 15/118
6,775,927 B2 * 8/2004 Glicksman ..... A43B 1/0081 36/36 R
7,140,130 B2 * 11/2006 Brooks ..... A43B 7/1415 36/180
7,159,342 B2 * 1/2007 Grisoni ..... A43B 7/1425 36/180
7,506,459 B2 * 3/2009 Grisoni ..... A43B 7/1425 36/180
8,001,706 B2 * 8/2011 Jeffers ..... A43B 3/0078 2/239
8,015,731 B2 * 9/2011 Jackson ..... A43B 3/24 36/101
8,316,563 B2 * 11/2012 Wegner ..... A43B 3/24 36/100
8,413,351 B1 * 4/2013 Watters ..... A43B 1/0054 36/100
8,443,528 B2 * 5/2013 Kann ..... A43B 3/18 36/101
8,453,355 B2 * 6/2013 Kay ..... A43B 5/185 36/135
8,671,588 B2 * 3/2014 Hampton ..... A43B 3/0078 36/7.1 R
8,800,170 B1 * 8/2014 Khaitan ..... A43B 17/026 36/28
8,800,171 B1 * 8/2014 Khaitan ..... A43B 17/026 36/28
8,813,391 B1 * 8/2014 Khaitan ..... A43B 21/00 36/28
8,984,669 B2 * 3/2015 Song ..... A41B 11/007 2/239
9,038,286 B2 * 5/2015 Rucker ..... A43B 1/0027 36/72 R
9,265,303 B2 * 2/2016 Hoogerbrugge ..... A43B 23/24
9,635,900 B1 * 5/2017 Rolle ..... A43B 3/18
2002/0069553 A1 * 6/2002 March ..... A43B 3/163 36/7.1 R
2003/0088996 A1 * 5/2003 Hall ..... A43B 23/24 36/2 R
2003/0088997 A1 * 5/2003 Mihailovich ..... A43B 3/16 36/7.1 R
2003/0154626 A1 * 8/2003 Larson ..... A43B 13/226 36/7.6
2003/0177664 A1 * 9/2003 Monassebian ..... A45C 3/08 36/100
2004/0159011 A1 * 8/2004 Gordon ..... A43B 1/00 36/7.1 R
2004/0168353 A1 * 9/2004 Bussler ..... A43B 21/00 36/34 R
2005/0022430 A1 * 2/2005 Terry ..... A43B 1/0081 36/72 R
2005/0039349 A1 * 2/2005 Grisoni ..... A43B 7/1425 36/71
2006/0005425 A1 * 1/2006 Votolato ..... A43B 13/26 36/7.3
2006/0005426 A1 * 1/2006 Votolato ..... A43B 3/16 36/7.3
2006/0086002 A1 * 4/2006 Vickers ..... A43B 3/16 36/7.1 R
2008/0184592 A1 * 8/2008 Brie ..... B29D 35/04 36/7.1 R
2008/0229615 A1 * 9/2008 Yu ..... A43B 3/20 36/100
2008/0235993 A1 * 10/2008 Wegner ..... A43B 3/20 36/101
2008/0289223 A1 11/2008 Adrover Bernabeu
2008/0301973 A1 * 12/2008 Lee Tsai ..... A43C 15/061 36/7.1 R
2009/0126223 A1 * 5/2009 Metzger ..... A43B 7/12 36/7.1 R
2009/0205222 A1 * 8/2009 McLinden ..... A43B 1/0045 36/92
2009/0229148 A1 * 9/2009 Giacoppo ..... A43B 1/0027 36/72 B
2009/0288314 A1 * 11/2009 Kay ..... A43B 13/12 36/91
2010/0162590 A1 * 7/2010 Bonigk ..... A43B 13/02 36/103
2010/0223818 A1 * 9/2010 Hampton ..... A43B 7/12 36/3 B
2012/0227281 A1 * 9/2012 Young ..... A43B 3/24 36/10
2013/0014408 A1 * 1/2013 Neilson ..... A43B 23/24 36/101
2013/0180127 A1 * 7/2013 Haslam ..... A43B 7/12 36/7.1 R
2013/0263468 A1 * 10/2013 Ciccarelli ..... A43B 3/16 36/7.1 R
2013/0318826 A1 * 12/2013 Nathaniel ..... A43B 17/18 36/97
2014/0082974 A1 * 3/2014 Rucker ..... A43B 3/246 36/72 R
2014/0202045 A1 * 7/2014 Glassman ..... A43B 7/12 36/72 B
2015/0000165 A1 * 1/2015 Reiff ..... A43B 13/22 36/72 R
2015/0020417 A1 * 1/2015 Barnes ..... A43C 11/14 36/72 R
2015/0128457 A1 * 5/2015 Wright ..... A43B 23/30 36/72 B
2015/0265003 A1 * 9/2015 Lauria ..... A43B 3/0078 2/245
2015/0342289 A1 * 12/2015 Feng ..... A43B 5/14 36/7.2
2016/0106178 A1 * 4/2016 Monger ..... A43B 3/242 36/7.1 R

* cited by examiner

SHOE COVER

CROSS-REFERENCE TO RELATED APPLICATIONS

This application is a continuation-in-part of U.S. patent application Ser. No. 14/615,998 filed Feb. 6, 2015, which is incorporated by reference in its entirety.

TECHNICAL FIELD

The field of the invention is costume design as it relates specifically and exclusively to footwear, such as shoes.

BACKGROUND

Shoes serve several purposes. The first is utilitarian. Shoes protect ones feet. The second is style. Having shoes that match outfits, or at least complement one's daily wardrobe, is very much a part of looking stylish. Given our present-day style consciousness, women are buying more shoes than even before. It is estimated by the ECommerce fashion industry that both women's shoe sales and accessory sales will double between 2018 and 2022, indicating women are increasingly interested in having their feet fashionably dressed.

Every woman wants a pair of classic pumps for dress and ballerina slippers (otherwise known as 'my flats') for shopping and general comfort. These popular styles are commonly bought in beige and/or black in order to coordinate with most of the clothes in their closets.

Shoes come not only in every size, but also at every price. Serviceable shoes exist at $25.00 and $2,500, and at all prices there between. Women mostly buy the shoes they can afford, and, very often these days, skimp somewhere in the budget to purchase that extra pair to match a special outfit.

There have been some patents granted for changing the appearance of shoes.

Lin (U.S. Pat. No. 6,349,486) reveals a sandal comprised of a sole and two straps. The straps can be exchanged using a complex fastening device embedded in the sole. Difficulties attendant upon the device exist in addition to the limitation of this application: two-strap sandals.

Bauer (U.S. Pat. No. 4,377,042) reveals a complicated athletic shoe with a removable out-sole. The shoe includes an upper portion designed to fit an individual foot and ankle of a particular wearer, and is permanently attached to the insole. The outsole and insole are connected together by mating hook and pile members. Bauer does not attach the upper portion directly the sole base without an insole. Its purpose is to serve the athlete, not the fashion conscious woman.

Hartung (U.S. Pat. No. 5,983,528) uses a fastening device (a zipper), which attaches the upper to the sole, and extends at least partially around the peripheral region of the sole to form a barrier between the joining device and the interior space of the shoe. It is a complicated and unsightly device.

Bailey (U.S. Pat. No. 4,887,369) uses fasteners for attaching the shoe top to the shoe bottom. This again poses the introduction of a third element—as do the others—which is a system that can fail as well as an additional expense. Costly fastening systems diminish the value of utilizing the footwear.

All of the above-mentioned patents represent systems with third element attachments that are neither fail-safe nor cost effective.

SUMMARY

The present disclosure is related to a shoe cover and methods of making and using a shoe cover. The shoe cover is configured to cover a specific shoe in a specific size, designated for use with one or more shoe covers. It is important to emphasize that the covers are shape and size specific. For example, the shoe cover may be configured to disguise a pump, a classic ballerina slipper, a flat-heeled boot, or a high-heeled boot. In effect, the shoe cover becomes an additional skin on a shoe, such that the shoe cover appears to be the shoe itself.

The shoe cover may have a simple construction and may be configured (e.g., designed) to satisfy one or more considerations, such as style and/or safety. To satisfy a style consideration, a material of a particular shoe cover may include a stretchable fabric that is able to cover and/or conform to a shoe. To satisfy a safety consideration, a shoe cover may be configured to fit a size of a specific shoe model, thereby eliminating "slack" and/or "wiggle room" between the shoe and the shoe cover. Additionally, or alternatively, the shoe cover may include a gripping insert to create stability and/or to reduce or prohibit movement of shoe cover with respect to the shoe during use. The shoe cover provides a strong, safe, and reliable exterior for a particular shoe and enables an affordable option to change the appearance of a shoe without having to own multiple pairs of shoes.

The shoe cover is specifically designed to alter the shoe's entire appearance thereby making the shoe appear to be a different shoe entirely. Accordingly, one or more shoe covers can create a wardrobe of changes for a specific shoe. Each time a different shoe cover is used on the shoe creates a wardrobe change, or disguise. Each shoe cover has everything necessary to complete the effect of a shoe change, including a sole of its own, allowing the wearer the same access to the street as comfortably as with any other commonplace retail shoe. Having slipped on the disguise, it appears to be the shoe itself, and nobody can discern a difference. By having a specific pair of shoes for use with one or more shoe covers, many disguises to cover or 'costume' the pair of shoes are available: a tiger striped shoe cover on Monday, a leopard-spotted shoe cover on Tuesday, a two-toned shoe cover on Wednesday, a purple suede shoe cover on Thursday, a polka-dotted shoe cover on Friday, and a red satin shoe cover for that special occasion on Saturday night. The covers or costumes are easily affordable and cost effectively produced.

Some implementations of the present embodiments include a shoe cover constructed from stretchable material having inside and outside portions including a toe, vamp, heel, and sole, and meant for use as the skin of a particular specified shoe in the size of that model shoe required by the consumer.

Some implementations of the present embodiments include a shoe cover constructed from stretchable material having inside and outside portions including a toe, vamp, heel, and sole containing a gripping insert made of a non-slip material, such as rubber, glued with industrial adhesive or otherwise attached into the inside portion of the cover from the toe to heel for the express purpose of protection; that is, keeping the cover in place on the shoe to avoid slippage within the body of the cover thereby insuring the safety of the wearer.

Some implementations of the present embodiments include shoe covers constructed from stretchable material having inside and outside portions including a toe, vamp, heel, and a sole whose structure has been engineered to support the upper part of the cover allowing it to stay in place on the shoe without the need for any other means of support such as hooks, elastics, tapes or other fastening devices.

Some implementations of the present embodiments include a shoe cover comprising: an upper piece configured to cover an upper portion of a shoe of a wearer, the upper piece sized to cover the upper portion of the shoe without being attached to the shoe while the shoe is worn; a heel cover coupled to the upper piece and configured to receive and cover a heel of the shoe; a sole piece coupled to a bottom of the upper piece and configured to grip surfaces as the wearer uses the shoe cover; and a back counter piece coupled to a bottom of the heel cover and configured to grip the surfaces as the wearer uses the shoe cover.

In some such implementations, the shoe cover may further comprise a gripping insert with a cavity formed by the upper piece, the gripping insert configured to generate friction between the upper piece and the shoe such that the upper piece does not slip along the shoe. Additionally, or alternatively, the upper piece may include a seam along the sole of the shoe, the gripping insert extending from toe to heel configured to cover at least a portion of the seam. In a particular implementation, the gripping insert extends from toe to heel and is configured to cover the entire seam.

In some implementations of the present embodiment, the sole piece is coupled to the upper piece using an attachment means, the upper piece and the heel cover are of a shape and size according to the shoe, or both. Additionally, or alternatively, the upper piece and the heel cover are fabricated of a same material with a same pattern design.

Some details associated with the aspects of the present disclosure are described above, and others are described below. Other implementations, advantages, and features of the present disclosure will become apparent after review of the entire application, including the following sections: Brief Description of the Drawings, Detailed Description, and the Claims.

BRIEF DESCRIPTION OF THE DRAWINGS

The following figures display the shoe cover and regarding them will help the viewer to understand the assembly and the outcome.

DETAILED DESCRIPTION

Figure 1A:
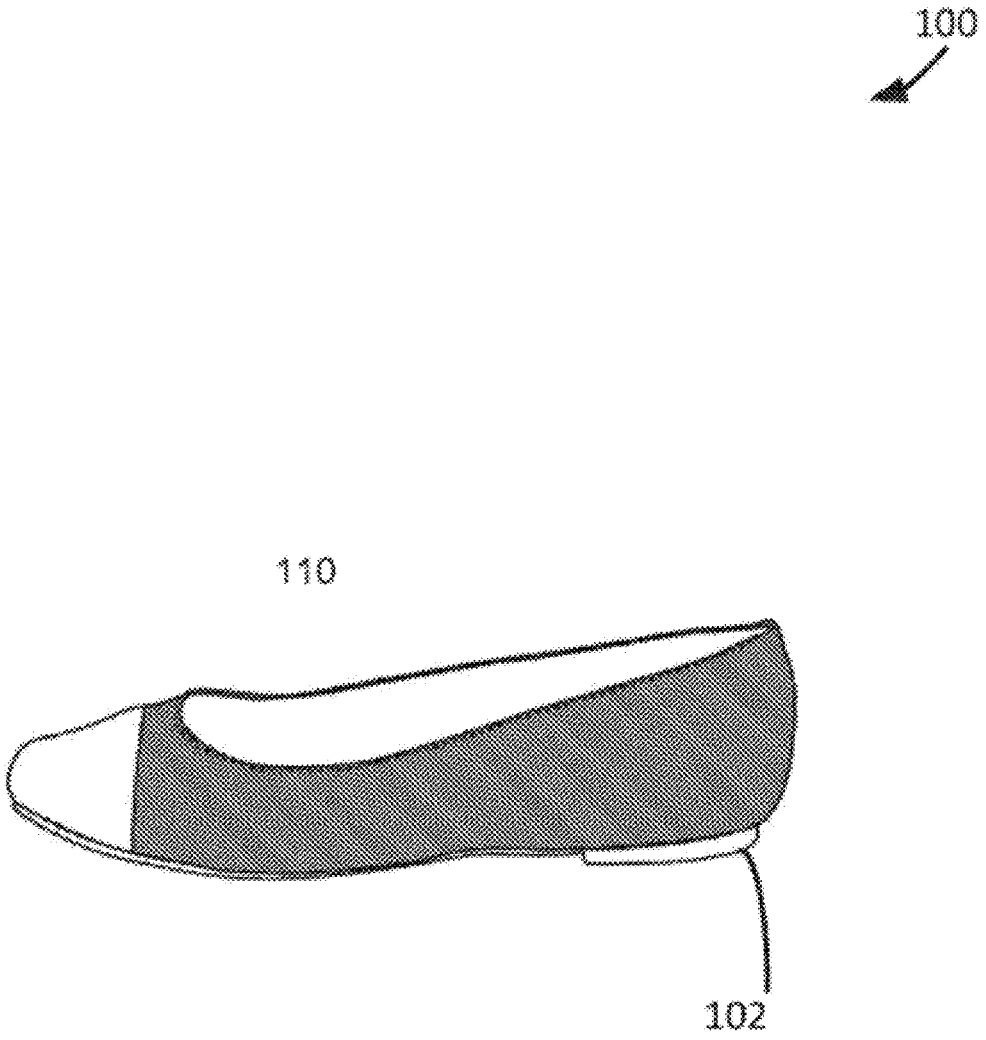
FIG. 1A is a side view of a shoe cover according to some embodiments.

FIG. 1A is a side view of a shoe cover 100 according to some embodiments. The shoe 110 includes a heel 102. The heel 102 can be of a size according to a style and or a type of shoe that shoe cover 100 is configured to fit around. For example, if the shoe cover 100 is for a ballerina slipper, as shown in FIG. 1A, the heel 102 can be of a smaller size.

Figure 1B:
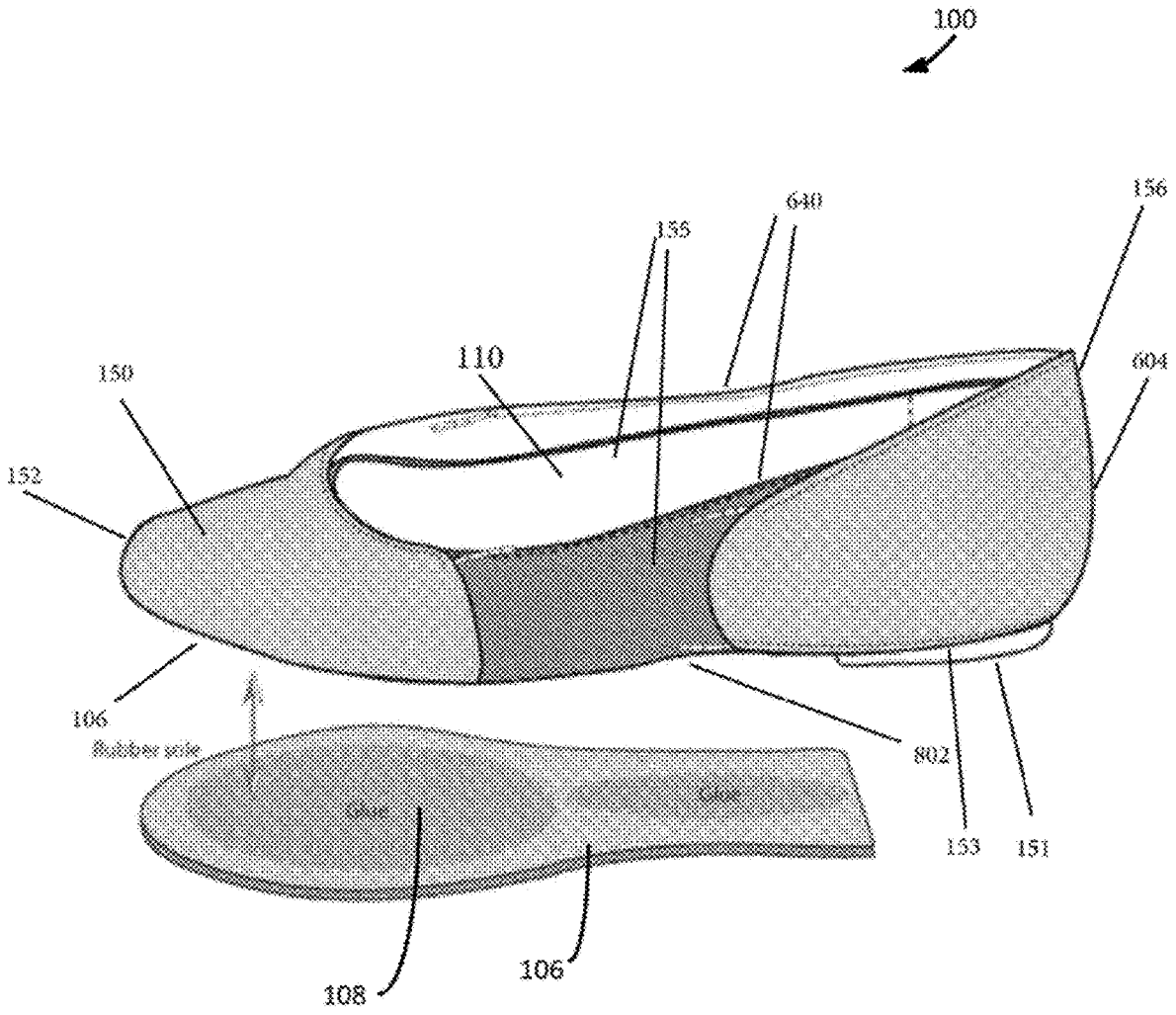
FIG. 1B is an exploded view of a shoe cover and a sole piece attached to the shoe cover.

The shoe cover 100 can be of a specific design or pattern. For example, the shoe cover 100 can have a leopard print pattern. In various embodiments, the shoe cover 100 can be shaped to cover all or a portion of a shoe. For example, the shoe cover 100 can be shaped to cover the shoe 110 (as shown in FIG. 1A and FIG. 1B) such that the tip of the shoe remains exposed. The shoe cover 100 can be of a size to fit securely around a shoe or a portion of a shoe without slipping or moving on the surface of the shoe during wear completely without the use of affixing means, such as hooks, zippers, Velcro®, or adhesives. In various embodiments, the shoe is configured so that it may be fitted with a plurality of different outer covers. In being configured to be fitted with a plurality of different outer covers, a wearer of a particular pair of shoes can give the appearance that they are wearing different shoes even though they are actually wearing the same pair.

FIG. 1B is an exploded side view of a shoe cover 100 and a sole piece 106 attached to the shoe cover 100. The sole piece 106 can be comprised of an applicable material for protecting a foot of a wearer of the shoe cover 100. Examples of applicable materials include rubber, leather, plastics, man-made materials, and natural materials. The sole 106 includes an attachment means 108 through which the sole 106 is attached to the shoe cover 100. An attachment means can include an applicable glue or adhesive. As illustrated in FIG. 1B, sole piece 106 extends continuously along the entire bottom surface 802 of shoe cover 100, from a toe portion 152 to a heel portion 604 of the shoe cover 100. Not all of the sole designed for a raised heel shoe is in contact with the ground while in use. Rather the sole it follows the contour of the designated raised heel shoe, which construction, in addition to the gripping insert, holds the cover firmly in place completely disallowing cover movement on the shoe. The toe 150, left and right side portions 155, back side 156, and sole 106 of the shoe 110 are shown covered by the shoe cover 100.

After taking measurements of the shoe last and the shoe itself, the template for a shoe cover is created. For example, the template for a shoe cover comprised of four separate pieces, including the upper piece, heel cover, sole and back counter piece. The template pieces are laid down onto the chosen fabric or material and an outline of the template is drawn onto the material. Once all pieces of the template have been drawn, they are cut out. Alternatively, the template for a shoe cover can be comprised of two or three pieces.

Figure 2:
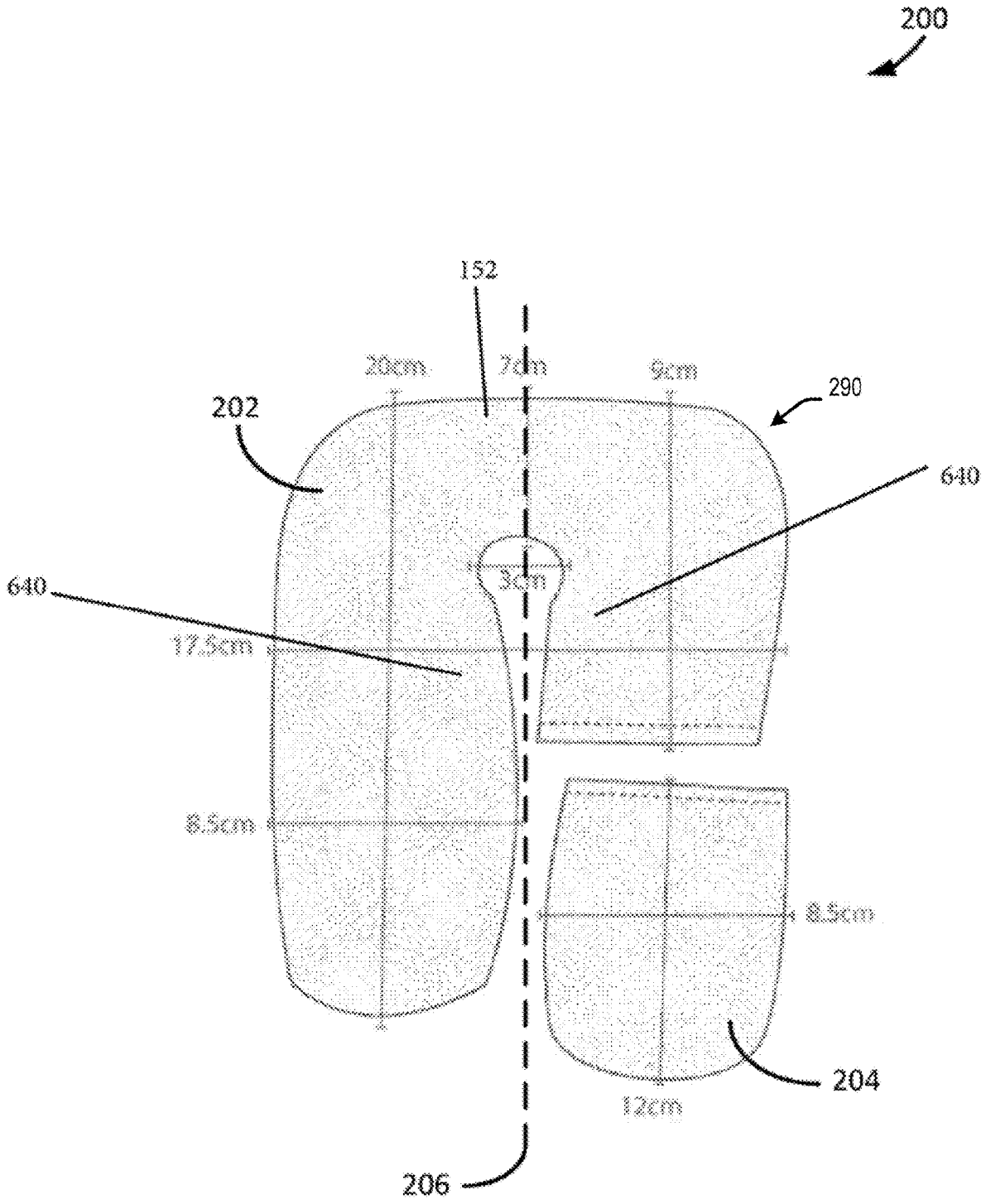
FIG. 2 is a view of an upper piece of a shoe cover.

FIG. 2 is a view of an upper piece 200 of a shoe cover. The upper piece 200 includes a back left piece 202 and a right counter piece 204. The back left piece 202 and the right counter piece 204 are sewn together through a ¼" seam. The upper piece 200 may be made of a material 290. For example, the material 290 may include a stretchable material configured to removably wrap entirely around the shoe of a wearer, and sized and shaped to conform to the measurements of the shoe.

After the back left piece 202 and the right counter piece 204 are sewn together to form the upper piece 200, then the upper piece 200 is folded in half along its central axis 206. The fold is made where the left and right sides 640 of the upper meet. The idea mimics taking pieces of paper and folding them in half in the portrait or horizontal position. Once the left and right sides of the upper piece 200 meet they are pinned and sewn together with a ¼" sewing seam along the edge of the upper piece 200. The upper piece 200 is sewn along the edge three quarters of the way around before stopping, in order to leave an un-pinned and unsewn hole (e.g., 690) for the heel of the shoe to pass through. For example, the hole can be 1" in diameter. Then continue to sew up the back counter (e.g., the heel portion 604) of the upper piece 200 where the heel passes. Doing so leaves a seam on the bottom part of the upper such that it is not viewed when worn by a wearer. Additionally, the gripping insert 510 glued into the bottom part of the upper and designed to cover the entire bottom of the upper from toe to heel not only conceals the seam on the bottom part of the upper but also assures the wearer the cover will not move on the shoe thereby guaranteeing the wearer's safety.

Figure 3:
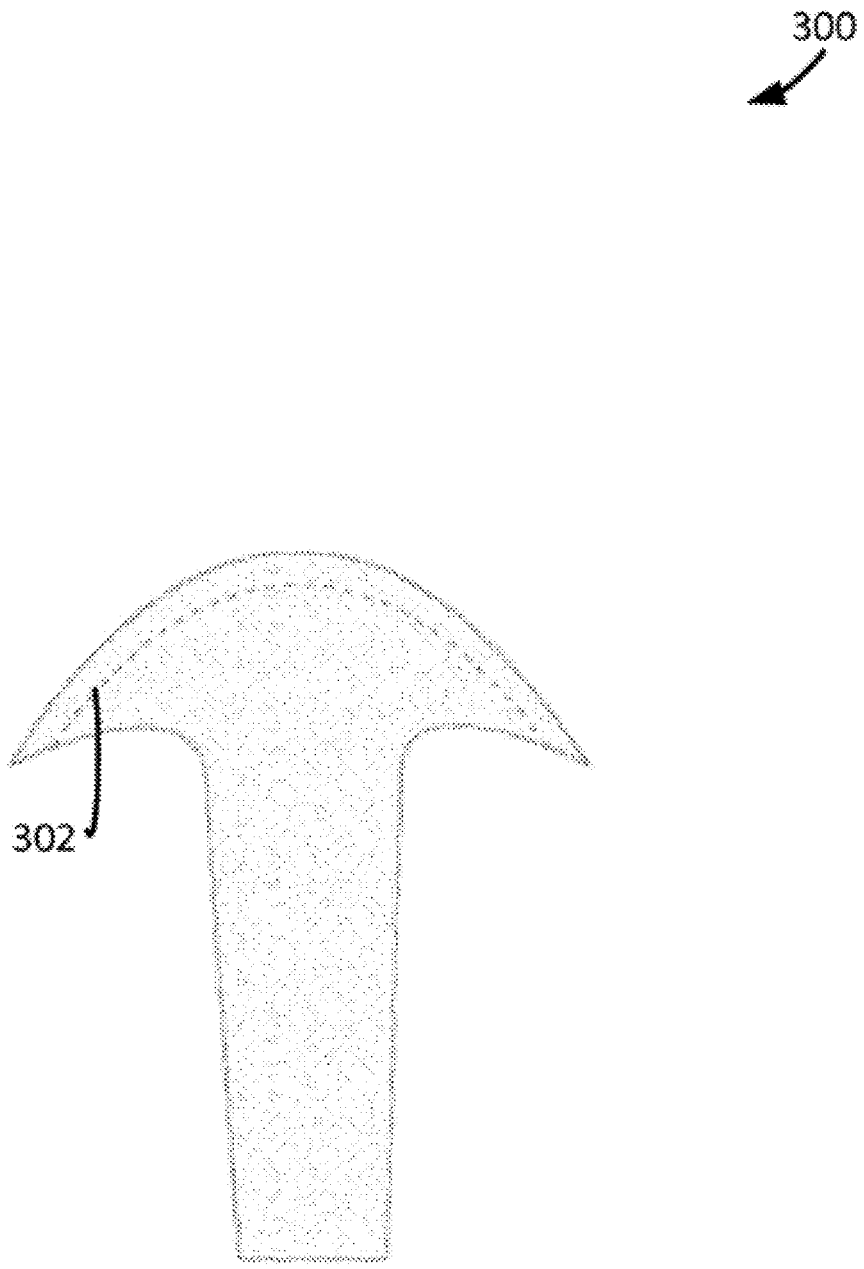
FIG. 3 is a view of a heel cover piece of a shoe cover.

FIG. 3 is a view of a heel cover piece 300 of a shoe cover. In forming the shoe cover, the heel cover piece 300 and the upper piece are turned inside out and the heel cover piece 300 is attached to the upper piece (e.g., 200) where the hole was left for the heel to pass through using an applicable attachment means, such as stitching, glue, and adhesive. The upper piece is attached to the heel cover piece 300 along line 302 shown in FIG. 3. The heel cover piece 300 can be sewn with a ¼" seam along the top of the heel cover and then folded in half where the two edges of the left and right sides of the heel cover, piece 300, meet. After the heel cover 300 is sewn onto the upper piece, the upper piece and the heel cover 300 are turned right side out.

Figure 4:
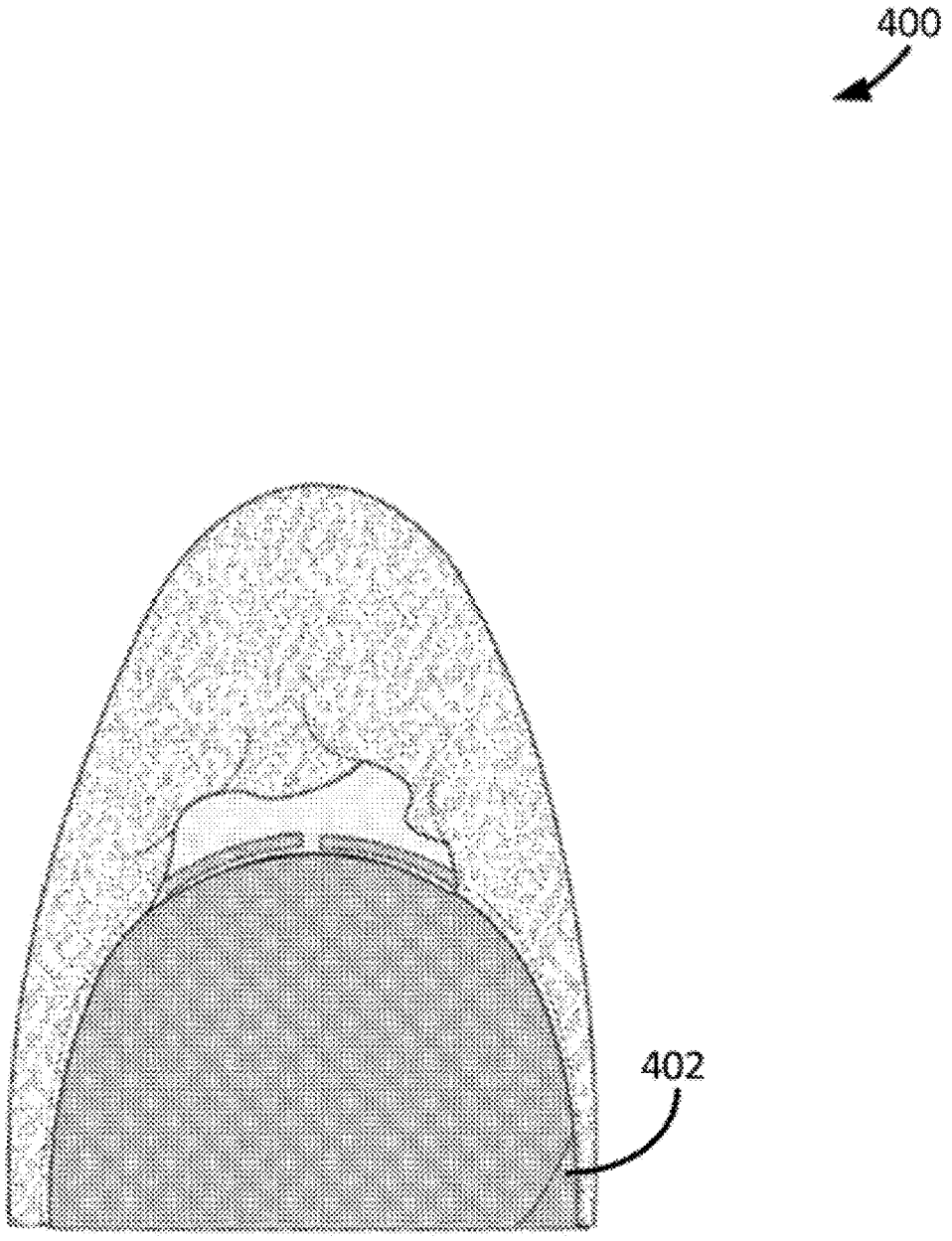
FIG. 4 is a top view of the upper piece.

FIG. 4 is a top view of the upper piece 200. The upper piece has an optional piece of elastic 402 sewn along the top so that the upper will not slide off the top of the shoe. The elastic is sewn at least three quarters of the way around the top of the upper piece. This elastic is so thin and the seam so small the elastic is almost invisible. This gives the fabric a gathered look but when stretched out the gathering of the material is not visible. This elastic is not necessary on most designated shoes.

Figure 5:
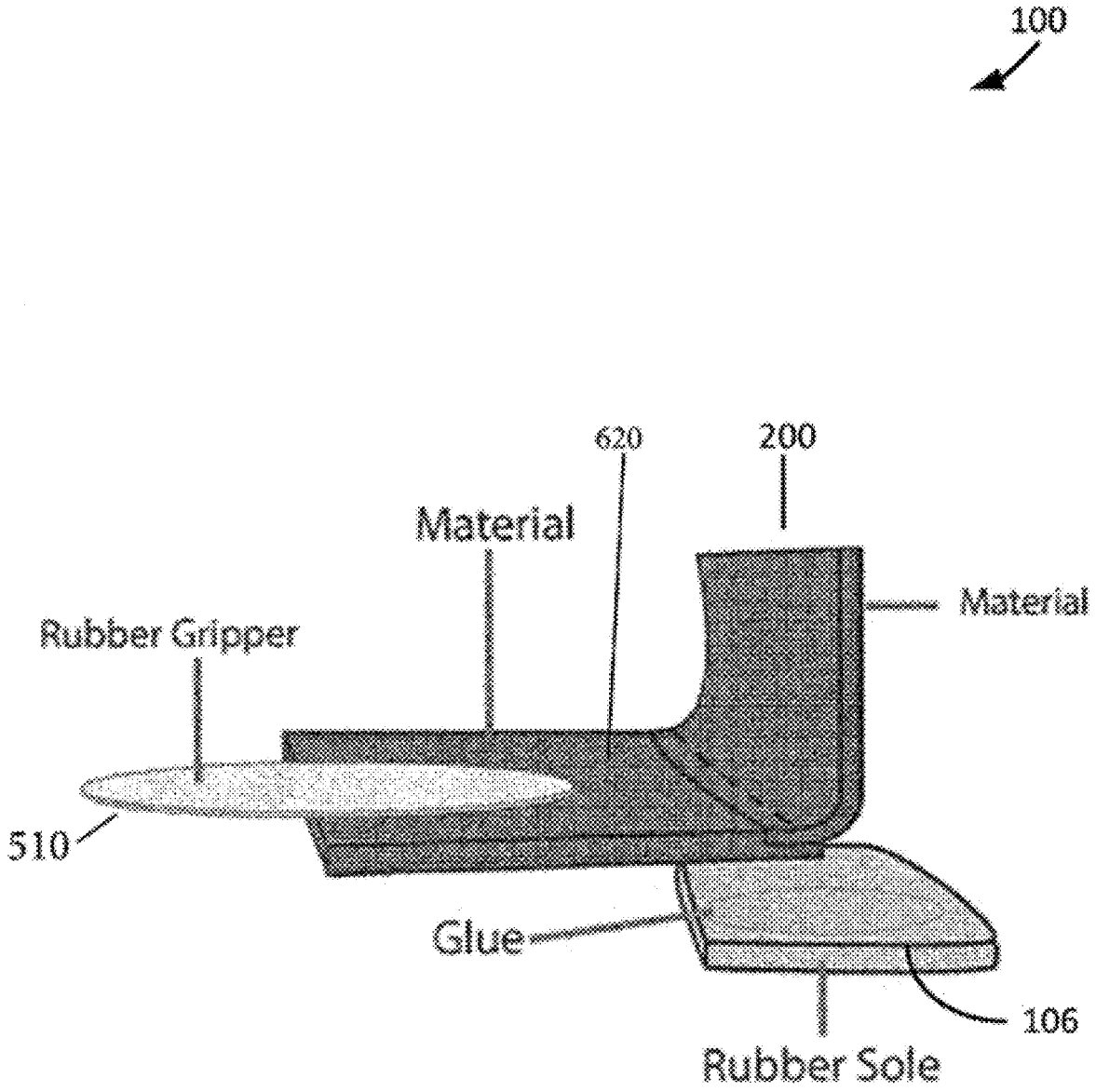
FIG. 5 is an exploded view of a shoe cover with a sole piece and an upper piece.

FIG. 5 is an exploded view of a shoe cover 100 with a sole piece 106 and an upper piece 200. The sole piece can match the bottom of the upper piece 200 to cover the entire bottom of the upper piece 200, or be shaped to cover a portion of the bottom of the upper piece 200. The sole piece 106 can be a ⅛" thick rubber sole matching the shape and size of the bottom of the upper piece 200. The sole piece can be attached to the bottom of the upper piece 200 through an applicable attachment means, such as glue or an adhesive. The sole functions to cover a seam created when folding the upper piece 200 to fit around a shoe. A gripping insert 510 can be included within the cavity formed by the folding of the upper piece 200. The gripping insert 510 can be configured to engage a shoe of a wearer of the shoe cover to prevent slipping of the shoe cover along the outer surface of the shoe. FIG. 5 also illustrates inner surface 620 and an outer surface 621 of shoe cover 100. As shown in FIG. 5, gripping insert 510 may be positioned so as not to extend to the edges of inner surface 620, and therefore not contact side portions 640 of upper piece 200. In some implementations, the gripping insert will, however, extend along the entire inner surface of the bottom from the toe potion to the heel portion to insure non-slip protection of the shoe within its cover when worn thereby guaranteeing the safety of the wearer.

Figure 6A:
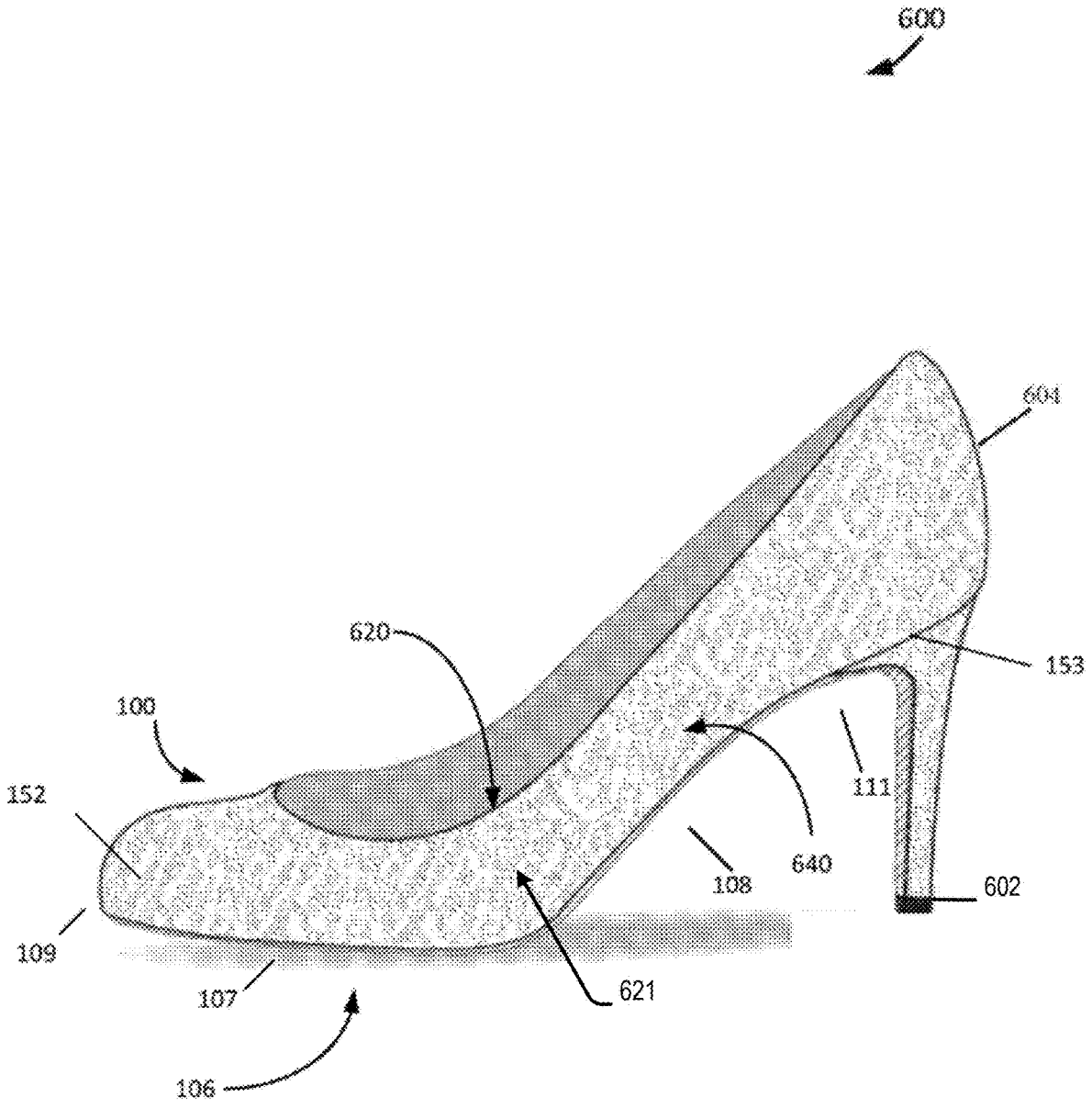
FIG. 6A is a side view of a shoe cover.
Figure 6B:
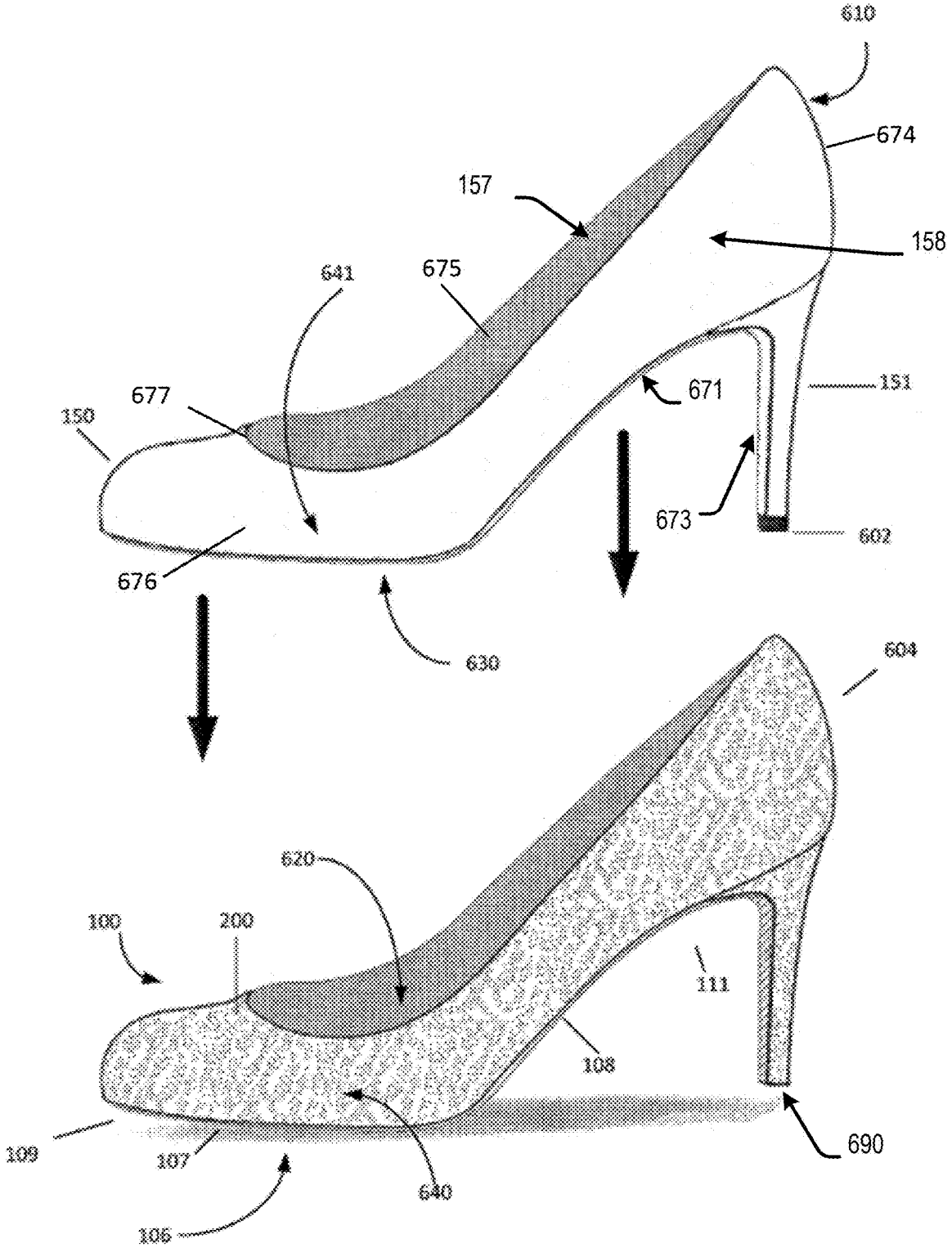
FIG. 6B is a side view of the shoe cover of FIG. 6A and a raised-heel shoe to be covered by the shoe cover.

Referring to FIGS. 6A and 6B, FIG. 6A is a side view of a shoe cover 100 and FIG. 6B is a side view of a shoe cover 100 and a raised-heel shoe 610 to be covered by the shoe cover 100. Referring to FIG. 6A, the shoe cover 100 includes a heel portion 604 (e.g., a back counter piece). The upper piece 200 of shoe cover 100 also includes side portions 640 and inner surface 620. Sole piece 106 has a ground contact portion 107 at a toe end 109 and a non-ground-contact portion 108 at a heel side 111. This aforesaid construction is engineered to ensure the cover will not move on the shoe while worn. As shown in FIG. 6A, sole piece 106 extends along the entire bottom surface (not illustrated in FIG. 6) of the upper piece 200 from the toe portion 152 to the heel portion 153 of the shoe cover 100.

As shown in FIG. 6A, the shoe cover 100 may be on the shoe 610 which can include heel lift piece 602 which can be coupled to the heel according to an applicable attachment means, such as glue or adhesive. The heel lift piece 602 can be a thin rubber grip or another applicable material with a high coefficient of friction.

Referring to FIG. 6B, shoe 610 includes the toe 150, heel 151, sides 641, sole 630, and a top line 677. Shoe 610 further includes shank 671 (e.g., arch support), heel breast 673, contour 674 (e.g., a counter section), and vamp 676. Shoe 610 may also include an inner surface 157 and an outer surface 158. In some implementations, inner surface 157 may include a lining 675, such as a sock lining. As shown in at least FIG. 6B, sole piece 106 extends along the entire bottom surface (not illustrated in FIG. 6B) of the upper piece 200 from the toe 150 to the heel 151 of the shoe 610. The ground contact portion 107 at the toe end 109 is configured to contact the ground when the shoe 610 and shoe cover 100 are worn, and the non-ground-contact portion 108 at the heel side 111 is configured to not contact the ground when the shoe 610 and shoe cover 100 are worn.

Figure 7:
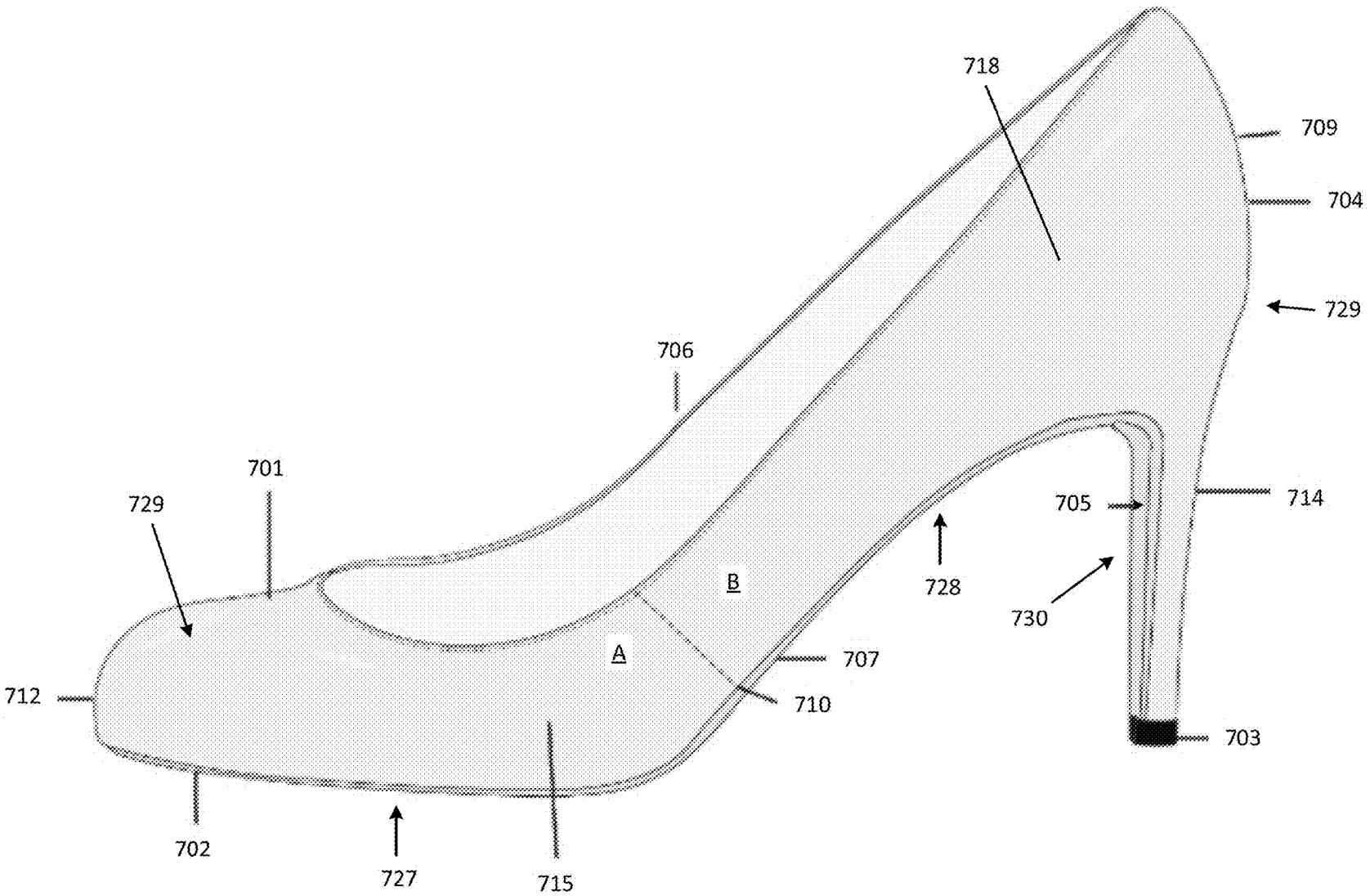
FIG. 7 is a side view of another example of a shoe cover.

Referring to FIG. 7, a side view of a shoe cover 701 is shown. The shoe cover 701 may include or correspond to shoe cover 100, such as the shoe cover 100 as shown at least in FIGS. 6A and 6B. Shoe cover 701 includes heel breast 705, shank 707, counter 709, toe 712, heel 714, and vamp 715. Counter 709 may be associated with or included in a counter section 718. Shoe cover 701 may also be understood to include an upper portion 729 and a heel portion 730. The heel portion 730 may extend downward from the upper portion 729.

As shown, shoe cover 701 is fitted over a shoe 706, such as a raised-heel shoe. Shoe 706 may include or correspond to raised-heel shoe 610. Shoe 706 may include a heel lift piece 703. Heel lift piece 703 may include or correspond to heel lift piece 602.

Shoe cover 701 includes one or more pieces of material, such as a first piece 'A' (having a first shape) and a second piece 'B' (having a second shape), and a sole 702 (e.g., an outsole). The first shape and the second shape may be the same shape or may be different shapes. An illustrative, non-limiting example first piece A and second piece B is described further herein at least with reference to FIG. 8. First piece A is coupled to second piece B by one or more seams. For example, the one or more seams may include a back seam 704 and an instep seam 710. In some implementations, shoe cover 701 may include a bottom seam (not shown in FIG. 7). An illustrative, non-limiting of a bottom seam is shown with reference to FIG. 10. Sole 702 may be coupled to at least one piece of material of shoe cover 701. To illustrate, sole 702 may be attached to the at least one piece of material by an adhesive, stitching, another attachment means, or a combination thereof. In some implementations, sole 702 may be attached to cover at least a portion of a bottom seam, at least a portion of instep seam 710, or both. An illustrative, non-limiting example sole 702 is described further herein at least with reference to FIG. 9.

The sole piece 702 may have a ground contact portion 727 configured to contact the ground and grip a surface as the wearer uses the shoe cover 701 and have a non-ground contact portion 728 configured not to contact the ground as the wearer uses the shoe cover 701. The contouring and construction of a non-contact portion is specifically designed to hold the upper in place securely, disallowing any movement of the upper on the shoe it covers. Additionally, or alternatively, the shoe cover 701 may include an optional elastic band (not shown). The elastic band may be positioned around a top of the shoe cover 701 and configured to prevent the shoe cover 701 from slipping relative to the raised heel shoe. The elastic band may include or correspond to the elastic band 402 or may be unnecessary.

Figure 8:
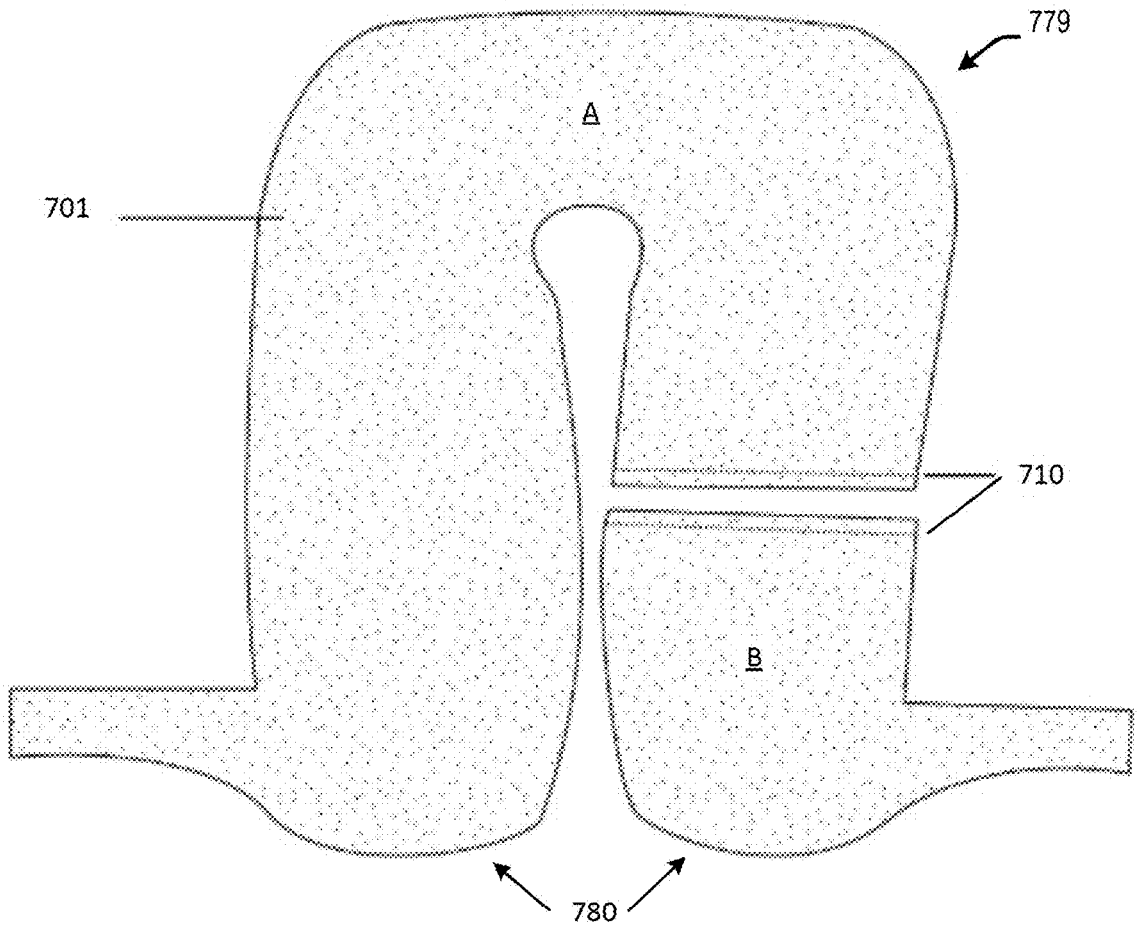
FIG. 8 is an example of pieces to form at least a portion of the shoe cover of FIG. 7.

Referring to FIG. 8, an example of the pieces of shoe cover 701 are shown. As shown, the pieces include first piece A and second piece B. First piece A and second piece B may be made of a material 779. Material 779 may include a stretchable material, configured to removably wrap entirely around the specific shoe (e.g., 706) of a wearer, and may be sized and shaped to conform to the measurements of the shoe (e.g., 706). First piece A and second piece B may include the same material or may include different materials. Material 779 may include or correspond to material 290. In some implementations, first piece A and/or first piece B may be cut from a larger piece of material based on a template or pattern. For example, the pattern may include a two-piece pattern having a first pattern piece that corresponds to first piece A and a second pattern piece that corresponds to second pattern piece B. In some implementations, the pattern may optionally include a third piece that corresponds to a sole (e.g., 702), as described further herein at least with reference to FIG. 9.

Each of first piece A and second piece B may have an inseam portion (e.g., 710) and/or may have a counter portion 780. The two inseam portions may be configured to be sewn together to form inseam 710 of shoe cover 701. The two counter portions (e.g., 780), may be configured to be sewn together to form back seam 704. Additionally, or alternatively, one or more portions of first piece A and/or one or more portions of second piece B may be sewn together to from a bottom seam, as described further herein at least with reference to FIG. 10.

Figure 9:
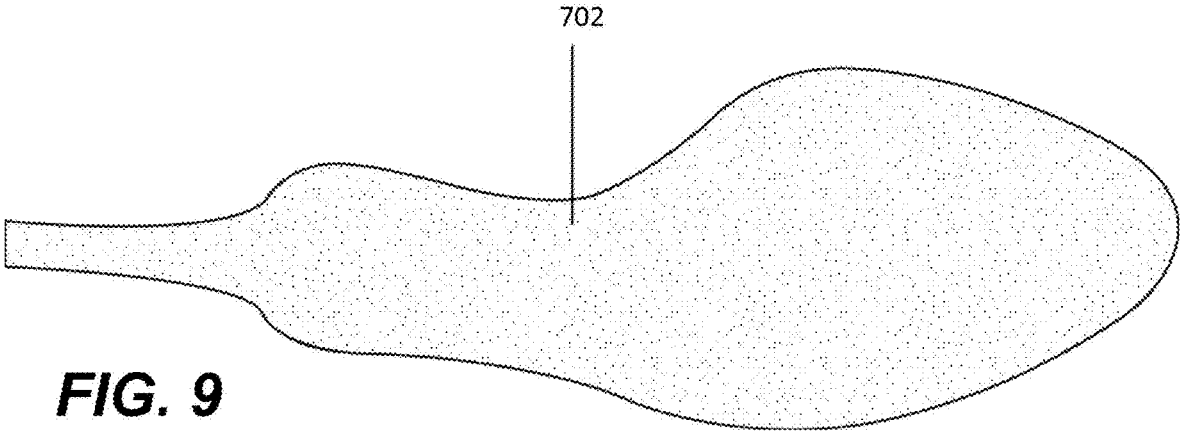
FIG. 9 is an example of another pattern for another portion of the shoe cover of FIG. 7.

Referring to FIG. 9, an example of a sole piece (e.g., 702) of shoe cover 701 is shown. The sole piece may be cut from a larger piece of material based on a template or pattern. The sole piece may be coupled to first piece A and/or second piece B of shoe cover 701 to form the soul 702 of shoe cover 701.

Figure 10:
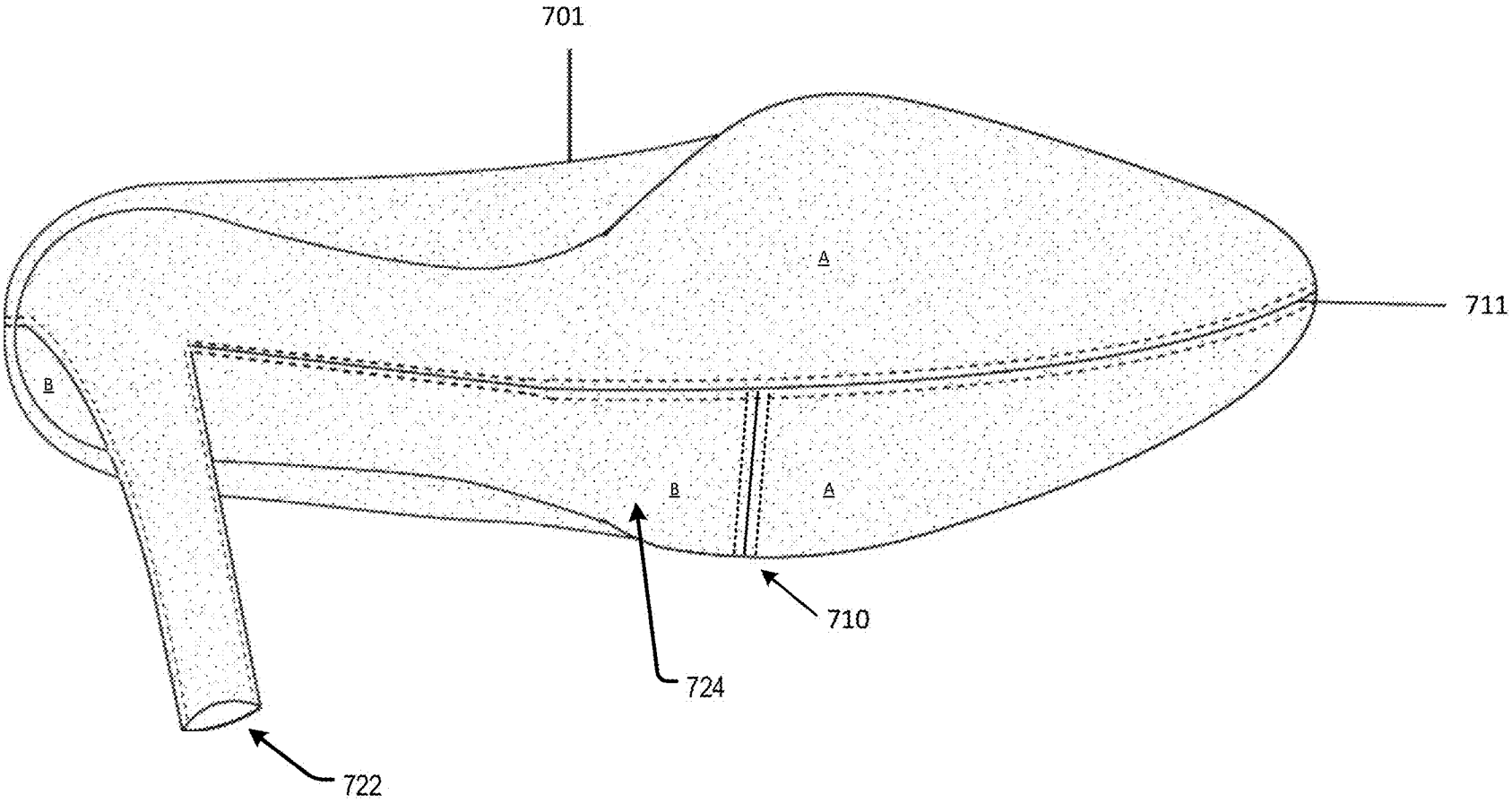
FIG. 10 is a bottom view of portions of coupled together.

FIG. 10 is a bottom view of shoe cover 701 without the sole piece (e.g., 702) of FIG. 9106. As shown in FIG. 10, and described above with respect to FIG. 8, shoe cover 701 may have a bottom seam 711 along the bottom surface (e.g., a bottom part 724). Additionally, as shown in FIG. 10, first piece A and second piece B have been sewn together to form an opening 722 (e.g., an unsewn hole) for the heel of a shoe to pass through. For example, the heel of the shoe may include or correspond to heel 151 of shoe 610.

Figure 11:
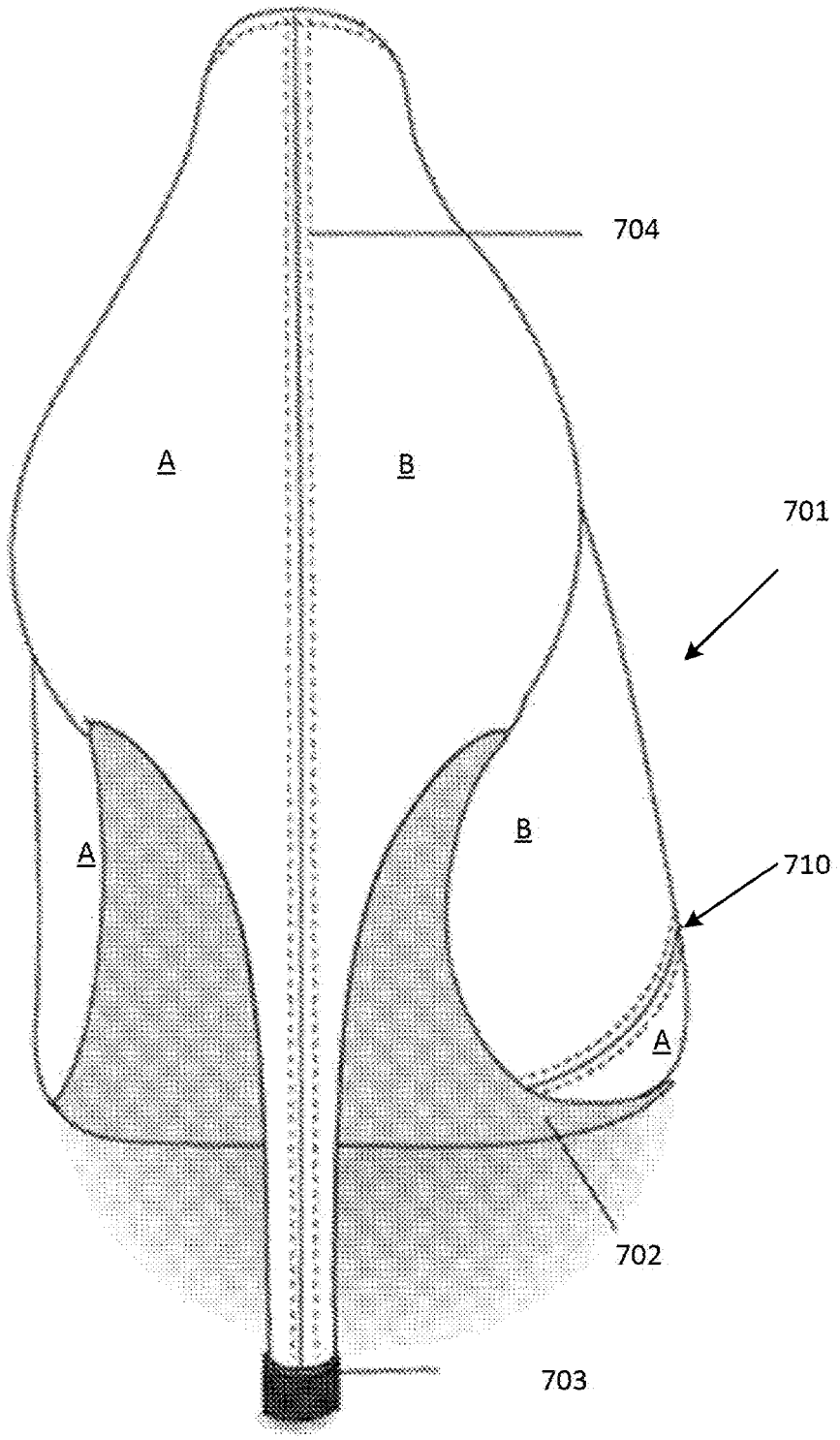
FIG. 11 is a rear view of a shoe covered by a shoe cover.

Referring to FIG. 11, a rear view of a shoe cover 701 is shown fitted over a shoe, such as shoe 706 having heel lift piece 703. As shown in FIG. 11, shoe cover 701 may have a back seam 704. FIG. 11 further illustrates sole piece (of FIG. 9) coupled to first piece A and second piece B to form soul 702 of shoe cover 701. The sole piece may be attached to first piece A and/or second piece B using glue, adhesive (e.g., an industrial adhesive), stitching, another attachment means, or a combination thereof, as illustrative, non-limiting examples. When attached, soul 702 covers a portion or an entirety of bottom seam 711.

Figure 12:
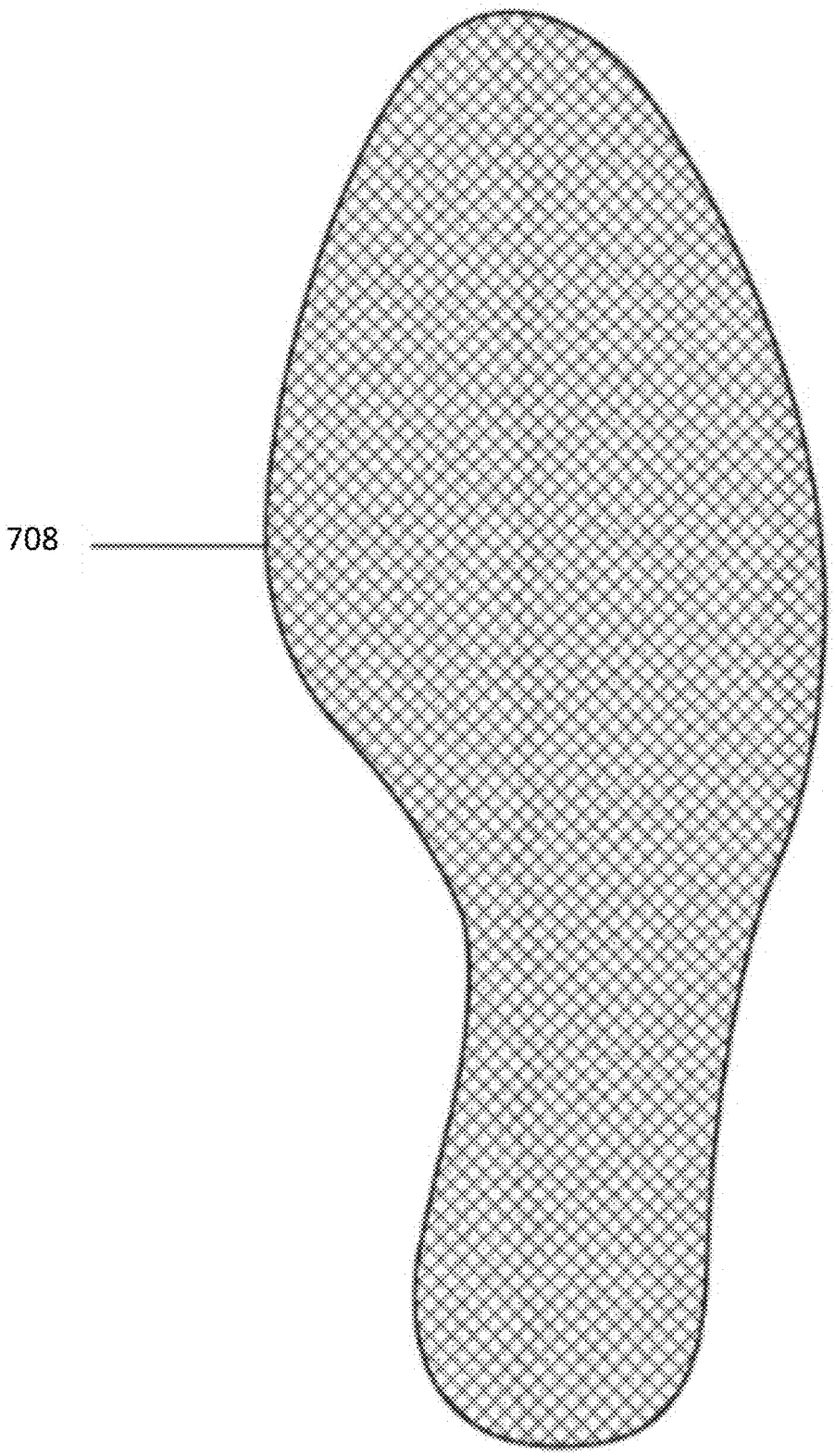
FIG. 12 is a view of a gripping insert of the shoe cover of FIG. 7.

Referring to FIG. 12, an example of a gripping insert 708 is shown. Gripping insert 708 may be made of a rubber material or other non-slip materials. Gripping insert 708 may be configured to be coupled to first piece A and/or second piece B of shoe cover 701. For example, gripping insert 708 may be configured to be inserted within a cavity of shoe cover 701 and coupled to first piece A and/or second piece B. For example, gripping insert 708 may be attached to first piece A and/or second piece B using glue, adhesive (e.g., an industrial adhesive), stitching, another attachment means, or a combination thereof, as illustrative, non-limiting examples. When attached, gripping insert 708 can be configured to engage a shoe (e.g., 706) of a wearer of shoe cover 701 to prevent slipping of the shoe cover 701 along an outer surface of the shoe 706. Additionally, or alternatively, when gripping insert 708 is attached to first piece A and/or second piece B, gripping insert 708 may cover a portion or an entirety of bottom seam 711 that is exposed from within the cavity of the shoe cover 701.

Figure 13:
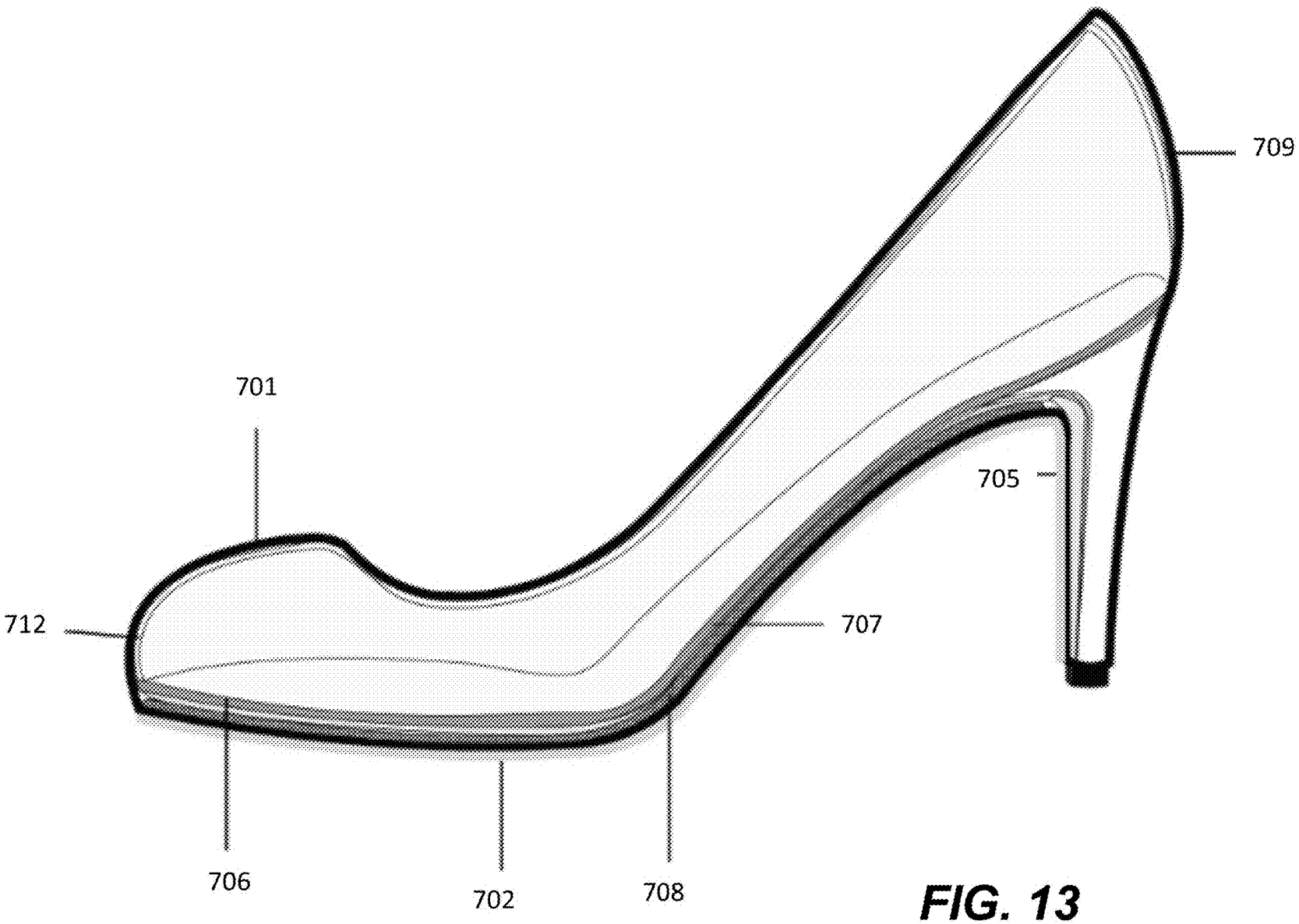
FIG. 13 is a cross-section of a shoe covered by the shoe cover of FIG. 7.

Referring to FIG. 13, a cross-section of shoe 706 covered by shoe cover 701 is shown. The gripping insert 708 is coupled to an inside portion of shoe cover 701 and extends between toe 712 and heel 714 (e.g., heel breast 705). In some implementations, gripping insert 708 is coupled to an inside portion of shoe cover 701 and extends between toe 712 and counter 709 (e.g., counter section 718).

Figure 14:
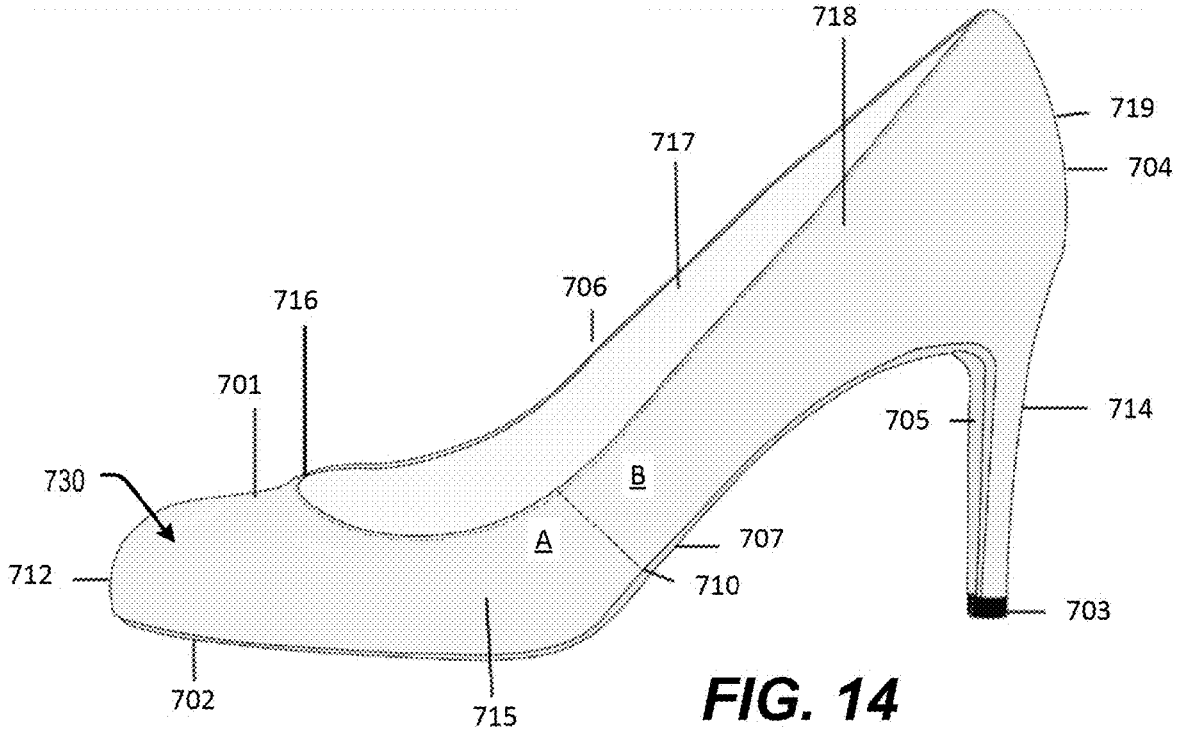
FIG. 14 is a side view of another example of a shoe cover.
Figure 15:
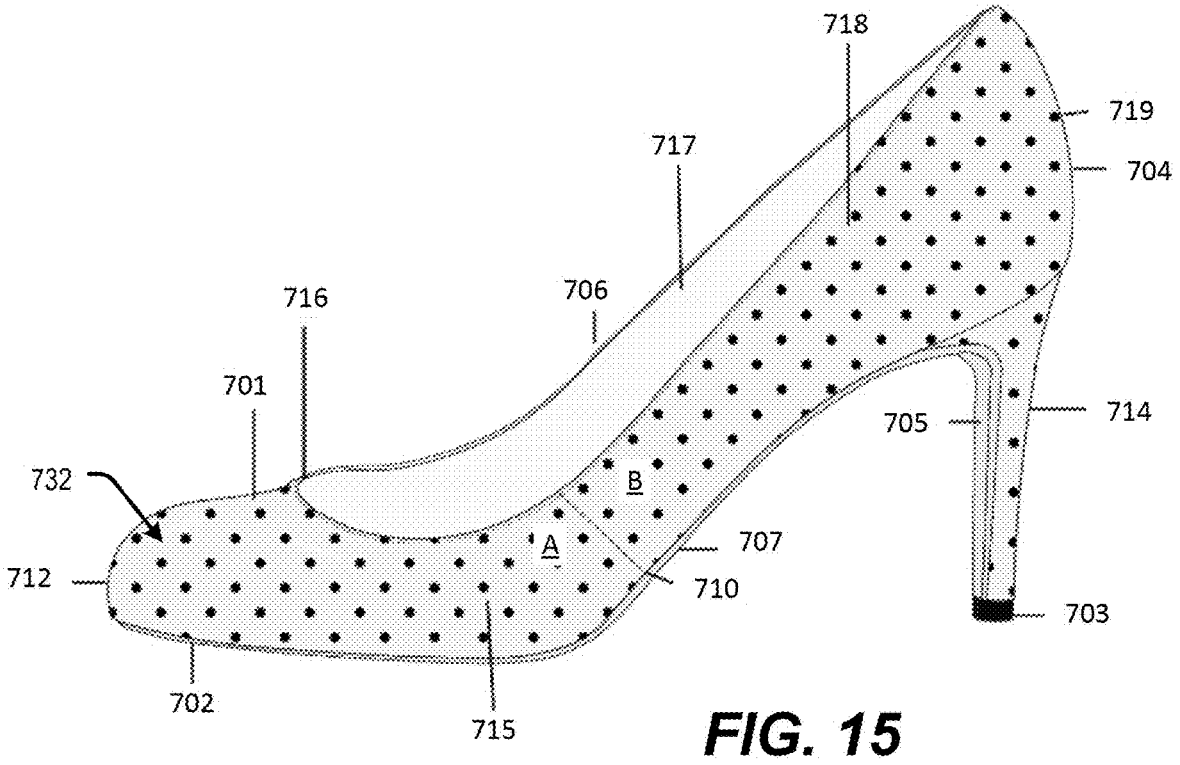
FIG. 15 is a side view of another example of a shoe cover.

Referring to FIGS. 14 and 15, side views of two examples of shoe covers (e.g., 701) are shown. Referring to FIG. 14, a first example of a shoe cover (e.g., 701) includes a first material 730 and covers shoe 706. Referring to FIG. 15, a second example of a shoe cover (e.g., 701) includes a second material 732 and covers shoe 706.

As described with reference to FIGS. 7-15, a pattern may be used to form first piece A and second piece B from a material (e.g., 779), such as a stretchable material. The first piece A and the second piece B may be sewn together to form instep seam 710 and counter portion of first and second pieces A, B may be sewn together to form back seam 714. Soul 702 (e.g., an outsole) may be attached (e.g., using an industrial adhesive) to bottom part 724. Additionally, or alternatively, gripping insert 708 may be coupled (e.g., using glue and/or an industrial adhesive) to inside of the first and second pieces A, B sewn together. Gripping insert coupled to the inside of shoe cover 701 may be made of a thin rubber material or other non-slip materials.

Thus, the present disclosure describes a shoe cover 701, such as a removable shoe cover, can be configured to be removably coupled to a shoe 706 (specific in both style and size) such as a raised heel shoe. For example, a first shoe cover (of one of FIG. 7, 14, or 15) may be slipped onto the shoe 706, and the shoe 706 (and shoe cover 701) can be worn by a wearer. After use, the first shoe cover 100 may be removed from the shoe 701 and a different shoe cover (of another of FIG. 7, 14, or 15), or the same shoe cover, can be used to cover the shoe 706.

The removable shoe cover 701, for the raised heel shoe (e.g., 706), may include a material 779, a bottom part 724, an unsewn hole 722, a sole piece (e.g., 7002), and a gripping insert 708. The material 779 may include a stretchable material configured to removably wrap entirely around the raised heel shoe of a wearer and sized and shaped to conform to the specific measurements of the raised heel shoe. For example, the material 779 may lay flat against an outer surface of the raised heel shoe while the raised heel shoe is worn (by a wearer). The bottom part 724 may be configured to cover an underside of the raised heel shoe. The underside of the raised heel shoe 706 may include including a sole, a shank, and a heel breast. In some implementations, the underside of the raised heel shoe 706 may include an entirety of each of a sole, a shank, and a heel breast. In a particular implementation, the underside of the raised heel shoe 706 does not include a bottom of the heel (e.g., a bottom of the heel lift piece 703) of the raised heel shoe 706. The bottom part may having an outer surface facing away from the underside of the raised heel shoe and an inner surface facing toward the underside of the raised heel shoe.

The unsewn hole 722 may be configured for a lift of a heel of the raised heel shoe to pass through. The sole piece 706 may be coupled to the outer surface of the shoe cover 701 and extend to cover the entire outer surface of the bottom part 724 continuously to an edge of the unsewn hole 722 so as not to cover the unsewn hole 722, and to follow the contour of the underside of the raised heel shoe, including the contour of the sole, the shank, and the heel breast of the raised heel shoe. The sole piece 702 may have a ground contact portion configured to contact the ground and grip a surface as the wearer uses the shoe cover 701 and have a non-ground contact portion configured not to contact the ground as the wearer uses the shoe cover 701.

The gripping insert 708 may include a rubber, non-slip, gripping insert configured to be positioned between the sole of the raised heel shoe and the inner surface of the shoe cover 701 when the shoe cover 701 is worn so as to lie against and contact the sole of the raised heel shoe.

The shoe cover 701 may include one or more seams (e.g., bottom seam 711) on the bottom part 724. The sole piece 702 may be configured to cover at least a portion of the one or more seams (e.g., the bottom seam 711).

The sole piece 702 may be coupled to the shoe cover 701 using an attachment means, such as the attachment means 108. For example, the attachment means may include glue and/or an adhesive. Additionally, or alternatively, the sole piece 702 may include rubber. In some implementations, the shoe cover 701 comprises a seam (e.g., 704) along a back counter (e.g., 709) of the shoe cover 701.

In some implementations, the shoe cover 701 comprises an upper portion (e.g., 200) and a heel cover portion. The upper portion and the heel cover portion may be fabricated of a same material (e.g., 779). Additionally, or alternatively, the gripping insert 708 may be configured to be positioned along the sole of the raised heel shoe that is configured for contact with the ground when worn.

The invention claimed is:

1. A removable shoe cover for a specific raised heel shoe, the shoe cover comprising:

a stretchable material configured to cover at least an upper portion and a sole of the raised heel shoe and to removably wrap entirely around the raised heel shoe, the stretchable material being sized and shaped to conform to measurements of the raised heel shoe so as to lie flat against the raised heel shoe while the raised heel shoe is worn by a wearer, at least a portion of the stretchable material forming a bottom part configured to cover an underside of the raised heel shoe, the underside of the raised heel shoe including an entirety of each of the sole, a shank, and a heel breast of the shoe, the bottom part having an outer surface facing away from the underside of the shoe and an inner surface facing toward the underside of the shoe;

an unsewn hole for a lift of a heel of the shoe to pass through;

a sole piece coupled to the outer surface of the bottom part and extending to cover the entire outer surface of the bottom part continuously from a toe end of the bottom part to an edge of the unsewn hole so as not to cover the unsewn hole, wherein the sole piece is further configured to follow a contour of the underside of the shoe, including a contour of the sole, the shank, and the heel breast of the shoe, the sole piece having a ground contact portion configured to contact the ground and grip a surface as the wearer uses the shoe cover and a non-ground contact portion constructed to support the stretchable material and configured not to contact the ground as the wearer uses the shoe cover; and a gripping insert configured to be positioned between the sole of the shoe and the inner surface of the bottom part when the raised heel shoe is worn, wherein the gripping insert extends continuously from a toe region of the inner surface to a rear shank region of the inner surface, such that the gripping insert is configured to engage the sole of the raised heel shoe and a majority of the shank of the raised heel shoe when the raised heel shoe is worn.

2. The removable shoe cover of claim 1, wherein: the sole piece is configured to cover at least a portion of a seam interposed between a first portion of the bottom part that corresponds to a contour of a toe of the shoe, and a second portion of the bottom part that corresponds to the contour of the heel breast of the shoe.

3. The removable shoe cover of claim 2, wherein: the sole piece is coupled to the bottom part using an attachment means.

4. The removable shoe cover of claim 3, wherein:

the attachment means includes glue; and the entirety of the seam is positioned between the first portion and the second portion.

5. The removable shoe cover of claim 1, wherein:

the sole piece comprises rubber; and when the removable shoe cover is coupled to and in use with the shoe, a side portion of the lift of the heel is visible.

6. The removable shoe cover of claim 1, wherein the sole piece matches a shape and size of the outer surface of the bottom part of the shoe cover.

7. The removable shoe cover of claim 1, wherein the shoe cover comprises a seam along a back counter of the shoe cover.

8. The removable shoe cover of claim 1, wherein the shoe cover comprises an upper portion and a heel cover portion.

9. The removable shoe cover of claim 8, wherein the upper portion and the heel cover portion are fabricated of a same material.

10. The removable shoe cover of claim 1, wherein the gripping insert is made of a non-slip material.

11. The removable shoe cover of claim 10, wherein the non-slip material is rubber.

12. The removable shoe cover of claim 1, wherein the gripping insert is sized and configured to cover the sole of the shoe.

13. A removable shoe cover for a raised heel shoe, the shoe cover comprising:

a stretchable material configured to cover at least an upper portion and a sole of the raised heel shoe and to removably wrap entirely around the raised heel shoe, the stretchable material being sized and shaped to conform to measurements of the raised heel shoe so as to lie flat against the raised heel shoe while the raised heel shoe is worn by a wearer;

at least a portion of the stretchable material forming a bottom part configured to cover an underside of the raised heel shoe, the underside of the raised heel shoe including each of the sole, a shank, and a heel breast of the raised heel shoe, the bottom part having an outer surface facing away from the underside of the raised heel shoe and an inner surface facing toward the underside of the raised heel shoe;

an unsewn hole configured for a lift of a heel of the raised heel shoe to pass through; wherein the stretchable material includes a first seam configured to couple a first piece of the stretchable material to a second piece of the stretchable material, the seam extending from a toe end of the shoe cover to the unsewn hole;

a sole piece coupled to the outer surface of the bottom part and extending to cover the entire outer surface of the bottom part continuously from the toe end of the shoe cover to an edge of the unsewn hole so as not to cover the unsewn hole, wherein the sole piece is further configured to follow a contour of the underside of the raised heel shoe, including a contour of the sole, the shank, and the heel breast of the raised heel shoe, the sole piece having a ground contact portion configured to contact the ground and grip a surface as the wearer uses the removable shoe cover and a non-ground contact portion constructed to support the stretchable material and configured not to contact the ground as the wearer uses the removable shoe cover; and a gripping insert configured to be positioned between the sole of the raised heel shoe and the inner surface of the bottom part when the raised heel shoe is worn, wherein the gripping insert extends continuously from a toe region of the inner surface to a rear shank region of the inner surface, such that the gripping insert is configured to engage the sole of the raised heel shoe and a majority of the shank of the raised heel shoe when the raised heel shoe is worn.

14. The removable shoe cover of claim 13, wherein the stretchable material further includes a second seam configured to couple the first piece to the second piece at a heel portion of the removable shoe cover.

15. The removable shoe cover of claim 14, wherein an entirety of the first seam is positioned between the toe end and the unsewn hole.

16. The removable shoe cover of claim 15, wherein:

the stretchable material further includes a third seam configured to couple the first piece to the second piece and extending from the first seam to a top opening of the removable shoe cover; and the sole piece includes rubber.

17. The removable shoe cover of claim 16, wherein, when the removable shoe cover is worn on the raised heel shoe, a side portion of the lift of the heel of the raised heel shoe is visible.

18. The removable shoe cover of claim 17, further comprising an elastic band positioned around a top portion of the removable shoe cover and configured to maintain the removable shoe cover on the raised heel shoe when the removable shoe cover is worn on the raised heel shoe.

* * * * *